US008622880B1

(12) United States Patent
Collett

(10) Patent No.: US 8,622,880 B1
(45) Date of Patent: Jan. 7, 2014

(54) STRETCHING ASSISTANCE SYSTEM

(76) Inventor: John M. Collett, Gilroy, GA (US)

( * ) Notice: Subject to any disclaimer, the term of this patent is extended or adjusted under 35 U.S.C. 154(b) by 197 days.

(21) Appl. No.: 13/352,899

(22) Filed: Jan. 18, 2012

(51) Int. Cl.
*A63B 21/00* (2006.01)

(52) U.S. Cl.
USPC ..... 482/130; 482/907; 482/140; 482/79

(58) Field of Classification Search
None
See application file for complete search history.

(56) References Cited

U.S. PATENT DOCUMENTS

| | | | | |
|---|---|---|---|---|
| 4,819,936 | A | 4/1989 | Muller | |
| 4,844,054 | A | 7/1989 | Raemdonck | |
| 5,004,228 | A | 4/1991 | Powers | |
| D344,771 | S | 3/1994 | Matsumoto | |
| 5,520,615 | A * | 5/1996 | Fontana et al. | 601/33 |
| 5,558,607 | A * | 9/1996 | Darling | 482/95 |
| 5,762,592 | A | 6/1998 | Neveux | |
| 5,863,280 | A * | 1/1999 | Wang | 482/140 |
| 6,110,078 | A * | 8/2000 | Dyer | 482/79 |
| 6,203,473 | B1 | 3/2001 | Atwood | |
| 6,338,700 | B1 * | 1/2002 | Pollock | 482/95 |
| 6,352,495 | B1 | 3/2002 | Hsu | |
| 6,689,025 | B2 * | 2/2004 | Emick | 482/123 |
| 6,699,162 | B2 * | 3/2004 | Chen | 482/140 |
| 7,458,922 | B2 | 12/2008 | Pisciottano | |
| 7,476,182 | B2 | 1/2009 | DeNisco | |
| 2004/0157712 | A1 | 8/2004 | Bodily et al. | |
| 2007/0191193 | A1 * | 8/2007 | Backes et al. | 482/79 |

OTHER PUBLICATIONS www.budovideos.com; Versaflex Leg Stretching Machine; internet; as of Jan. 17, 2010.
www.mykaratestore.com; Mechanical Leg Stretcher/Leg Stretching Machine; internet; as of Jan. 17, 2010.
www.proflexstretch.info; Proflex Stretching Machine; internet; date unknown.

* cited by examiner

*Primary Examiner* — Jerome W Donnelly

(57) ABSTRACT

A stretching assistance system featuring a base; a pivoting platform pivotally attached to the back of the base, and a footrest assembly extending upwardly from the base at the front end. The pivoting platform can pivot between multiple positions. The position of the footrest can be adjusted to accommodate the user's height. A first pulley component is disposed in the pivoting platform, and a second pulley component is disposed in the footrest. A rope is attached to the footrest and extends from the footrest to the first pulley component, back to the second pulley component, and extends outwardly from the second pulley component. A handle is attached to the second end of the rope. A locking cleat is disposed on the footrest. When the second end of the rope is pulled, the pivoting panel pivots toward the footrest. The locking cleat functions to hold the rope in a fixed position.

11 Claims, 8 Drawing Sheets

(Double Leg Toe Touch Stretch)

(Side View)

(Bottom View)

(Top View)

(Front View)

(Single Leg Toe Touch Stretch)

(Spread Eagle Stretch)

(Butterfly Stretch)

(Spread Eagle Stretch)

(Double Leg Toe Touch Stretch)

STRETCHING ASSISTANCE SYSTEM

FIELD OF THE INVENTION

The present invention is directed to fitness equipment, more particularly to a system designed to help a user stretch and maintain a stretched position without straining.

BACKGROUND OF THE INVENTION

Stretching, while an important part of fitness, can be very difficult for some individuals. For example, many people have difficulty maintaining a stretched position without straining. The present invention features a stretching assistance system designed to help a user to easily stretch areas including but not limited to the calves, hamstrings, lower back, and groin muscles. The system of the present invention helps a user maintain a static stretch and allows for a quick release if necessary.

The stretching assistance system helps provides mechanical assistance in stretching the hamstrings, lower back, calf muscles, and groin muscles by allowing the user to control the intensity of different stretch positions (e.g., five positions, e.g., toe touch, right leg toe touch, left leg toe touch, spread eagle and butterfly stretch) and "locking" them into place so that the user can relax and quickly release when finished. In some embodiments, the system adjusts for heights between about 3 feet to 6.5 feet. The footrest has a support flap used for some stretches, for example a spread eagle stretch and butterfly groin/lower back stretches. The system can fold to a storage position (e.g., generally flat) for easy storage under a bed or in a closet.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY

The present invention features a stretching assistance system. In some embodiments, the stretching assistance system comprises a generally elongated base having a front end and a back end, the base functions as a seat for a user; a generally elongated pivoting platform pivotally attached to the back end of the base via a first hinge, the pivoting platform functions to contact a user's back, the pivoting platform can pivot between multiple positions including a folded position wherein the pivoting platform is folded inwardly and positioned atop the base and generally flush with the base, and an extended position wherein the pivoting platform is at an angle (e.g., 120 degrees) with respect to the base, in the extended position a user can comfortably sit on the base; a footrest assembly disposed atop the base, the footrest assembly comprises a footrest base disposed atop the base at or near the front end of the base and a footrest platform pivotally attached to the footrest base via a footrest hinge, the footrest platform faces the back end of the base and can pivot about the footrest hinge between at least an extended position wherein the footrest hinge extends upwardly and generally perpendicularly from the footrest base and a storage position wherein the footrest platform is pivoted toward the footrest base such that it is atop and generally flush with the footrest base, the footrest assembly functions to support a user's feet when the user is sitting on the base with his back to the pivoting platform; an adjustment means for adjusting a position of the footrest assembly with respect to the front end of the base, the adjustment means functions to allow the stretching assistance system to accommodate users of various heights; a first pulley component disposed in the pivoting platform at or near a top end of the pivoting platform, and a second pulley component disposed in the footrest platform at or near a top end of the footrest platform; a rope having a first end and a second end, the first end of the rope is attached to the footrest assembly, the rope extends from the footrest assembly to the first pulley component and wraps around the first pulley component and further extends to the second pulley component and wraps around the second pulley component, the second end of the rope extends outwardly from the second pulley component; and a handle attached to the second end of the rope; and a locking cleat disposed on the footrest platform.

When the second end of the rope is pulled, the pivoting panel pivots toward the footrest. The locking cleat functions to temporarily hold the rope in a fixed position so that the user does not have to continue to pull on the rope during a stretch. Excess rope can be coiled around handle as it is rotated to keep handle in comfortable position for pulling.

In some embodiments, the stretching assistance system further comprises a first padding material (e.g., foam, rubber, or a combination thereof) disposed on a top surface of the base to provide comfort to the user. In some embodiments, the stretching assistance system further comprises a second padding material (e.g., foam, rubber, or a combination thereof) disposed on an inside surface of the pivoting platform (the inside surface faces the users back) for comfort. In some embodiments, the stretching assistance system further comprises a third padding material (e.g., foam, rubber, or a combination thereof) disposed on the inside surface of the footrest platform (the inside surface faces the users feet).

In some embodiments, the adjustment means comprises a plurality of adjustment holes disposed in the base at and near the front end of the base and hardware temporarily disposed in the footrest assembly and engaged in the adjustment holes. In some embodiments, the handle is a dowel handle for coiling up excess rope. In some embodiments, the stretching assistance system further comprises a side panel pivotally attached to a first side edge of the footrest platform via a side panel hinge to support the footrest platform when the users feet are not touching nor supporting the footrest platform in a vertical position (e.g., in the spread eagle and butterfly stretches).

DESCRIPTION OF PREFERRED EMBODIMENTS

Referring now to FIG. 1-6, the present invention features a stretching assistance system 100 designed to help a user to easily stretch areas including but not limited to the calves, achilles, hamstrings, lower back, and groin muscles. The stretching assistance system 100 of the present invention helps a user maintain a static stretch and allows for a quick release by the user when desired.

The system 100 of the present invention comprises a generally flat and elongated base 110 having a top surface, a bottom surface, a front end 115, and a back end 116. The base 110 functions as a seat for a user. In some embodiments, the top surface (or a portion thereof) of the base 110 is covered with a first padding material 118*a*, for example foam, rubber, the like, or a combination thereof. The first padding material 118*a* may provide comfort to the user when he/she sits on the base 110.

Figure 5:
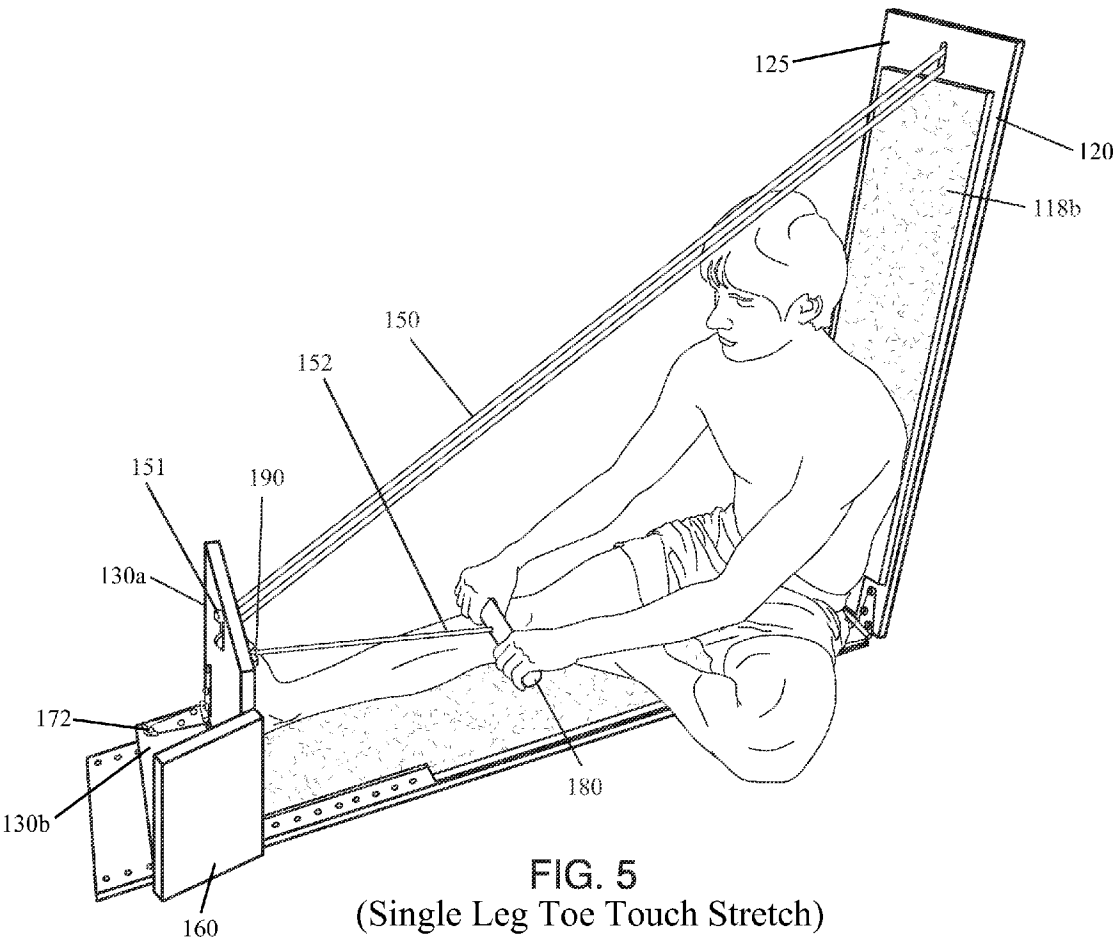
FIG. 5 is an in-use view of the stretching assistance system of the present invention (a single leg stretch is performed).
Figure 6:
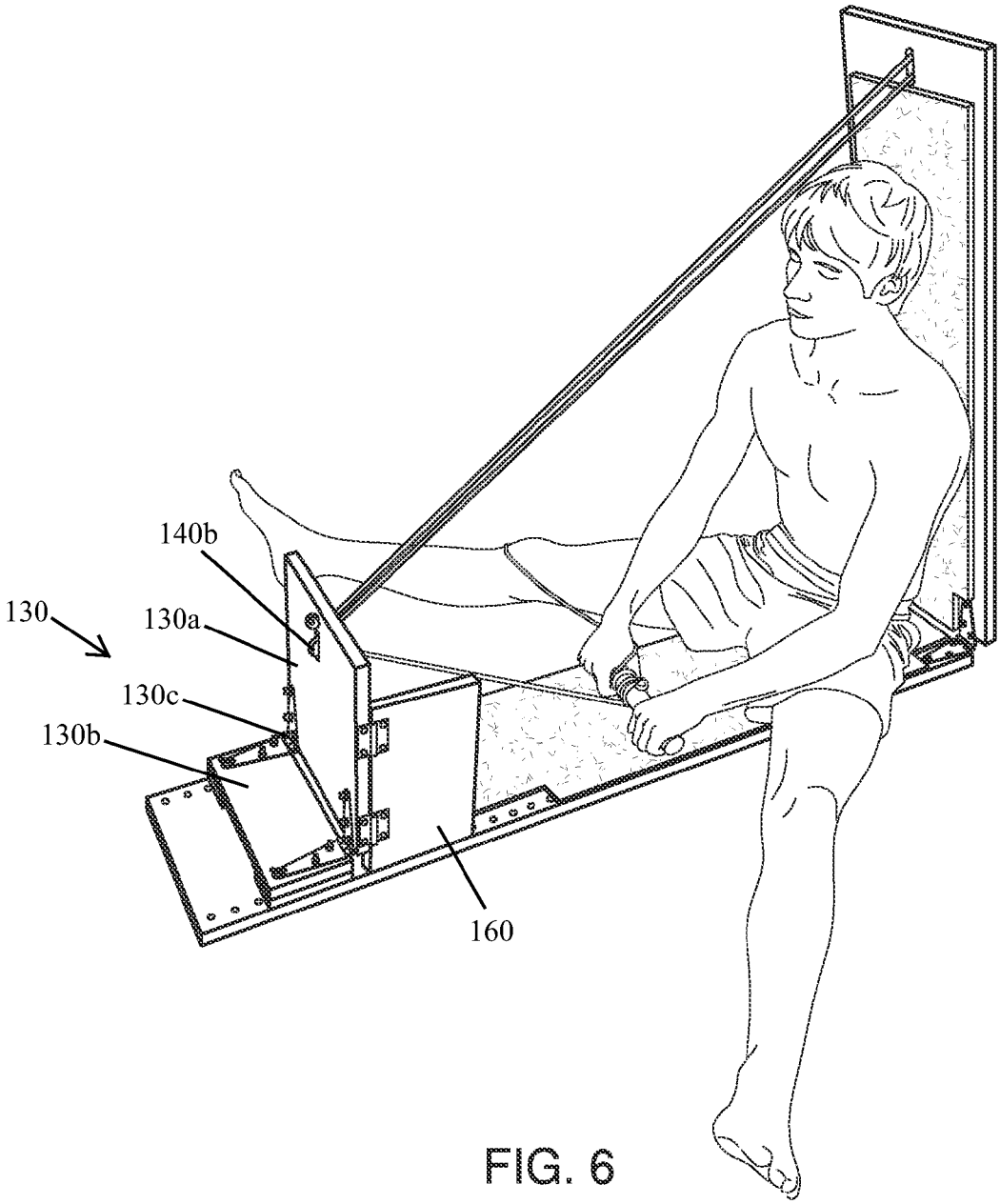
FIG. 6 is a perspective view of the footrest of the stretching assistance system of the present invention (a spread eagle stretch is performed with the side panel for support).
Figure 7:
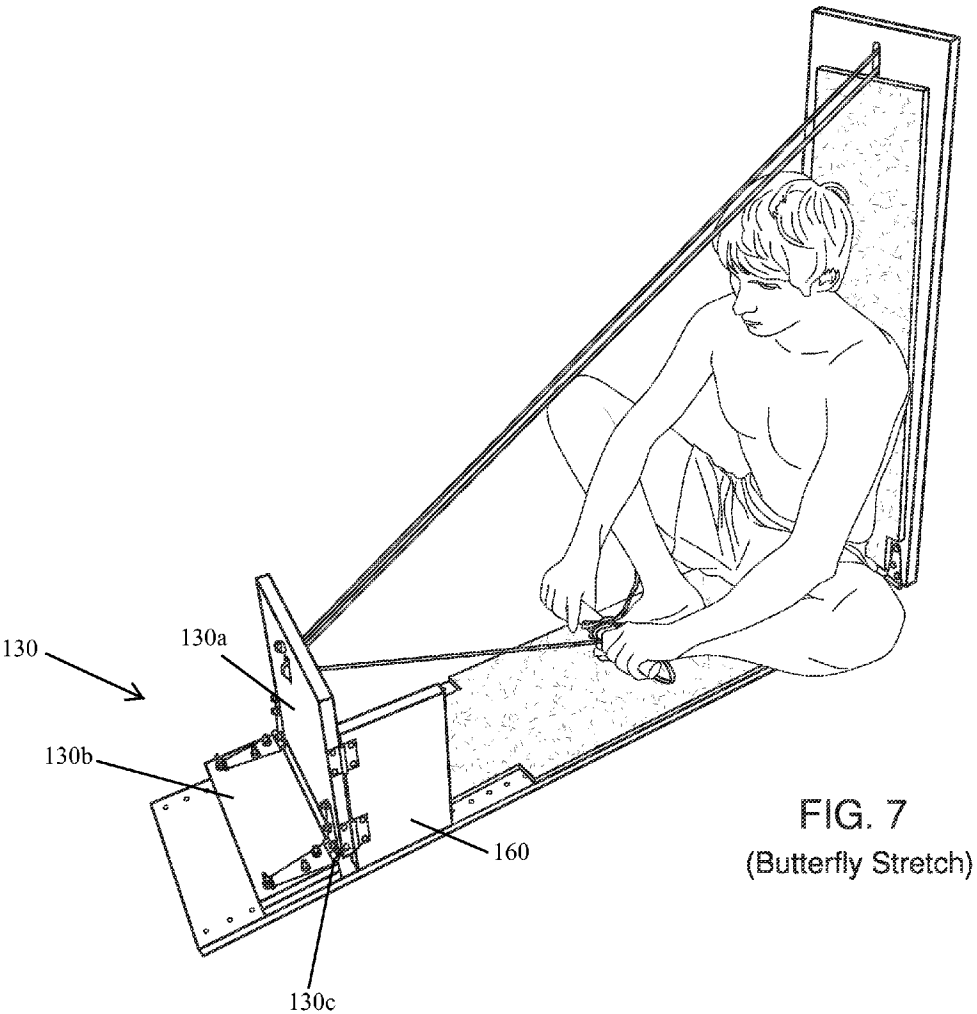
FIG. 7 is an in-use view of the stretching assistance system of the present invention (a butterfly stretch is performed, the side panel supports the footrest).
Figure 8:
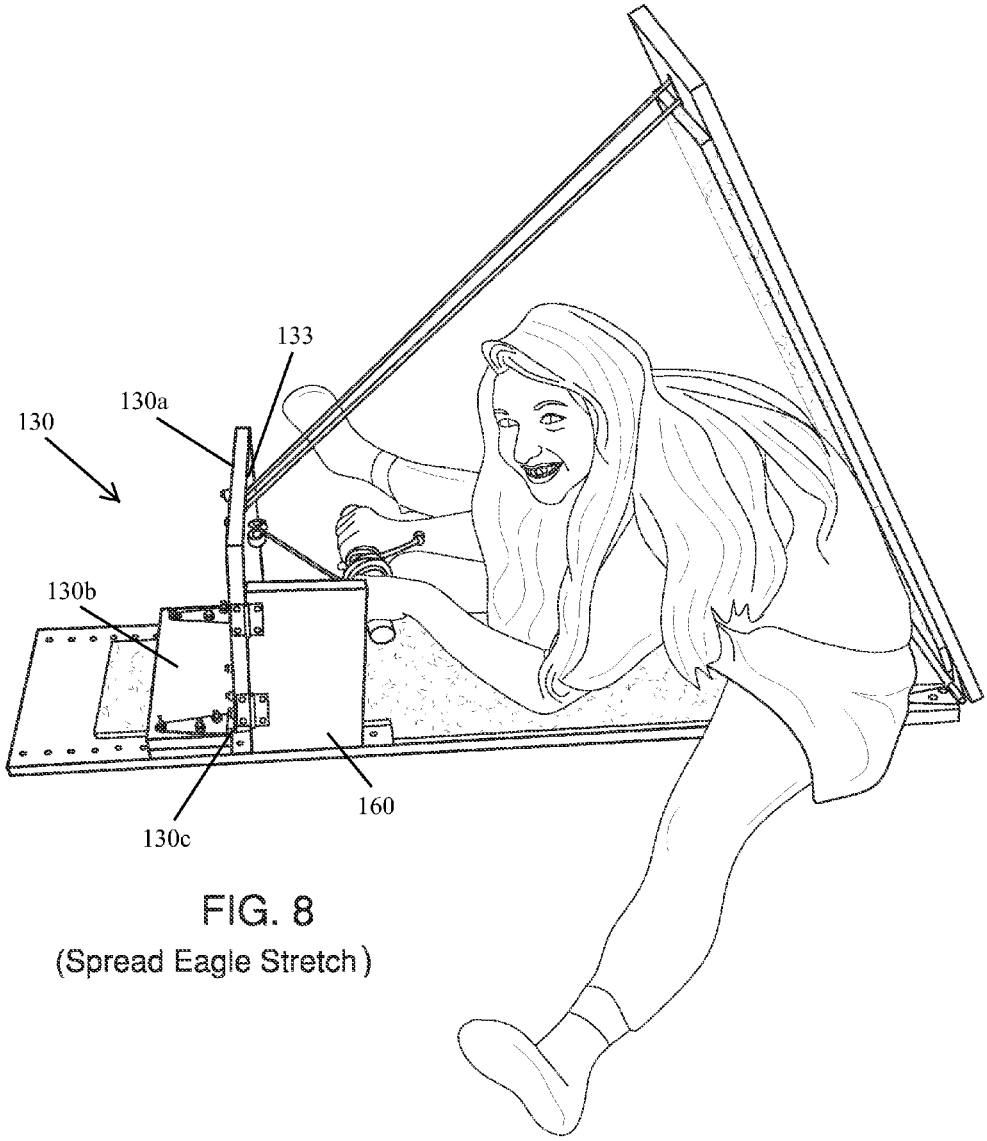
FIG. 8 is an in-use view of the stretching assistance system of the present invention (a female user with great flexibility is shown doing a spread eagle stretch).
Figure 9:
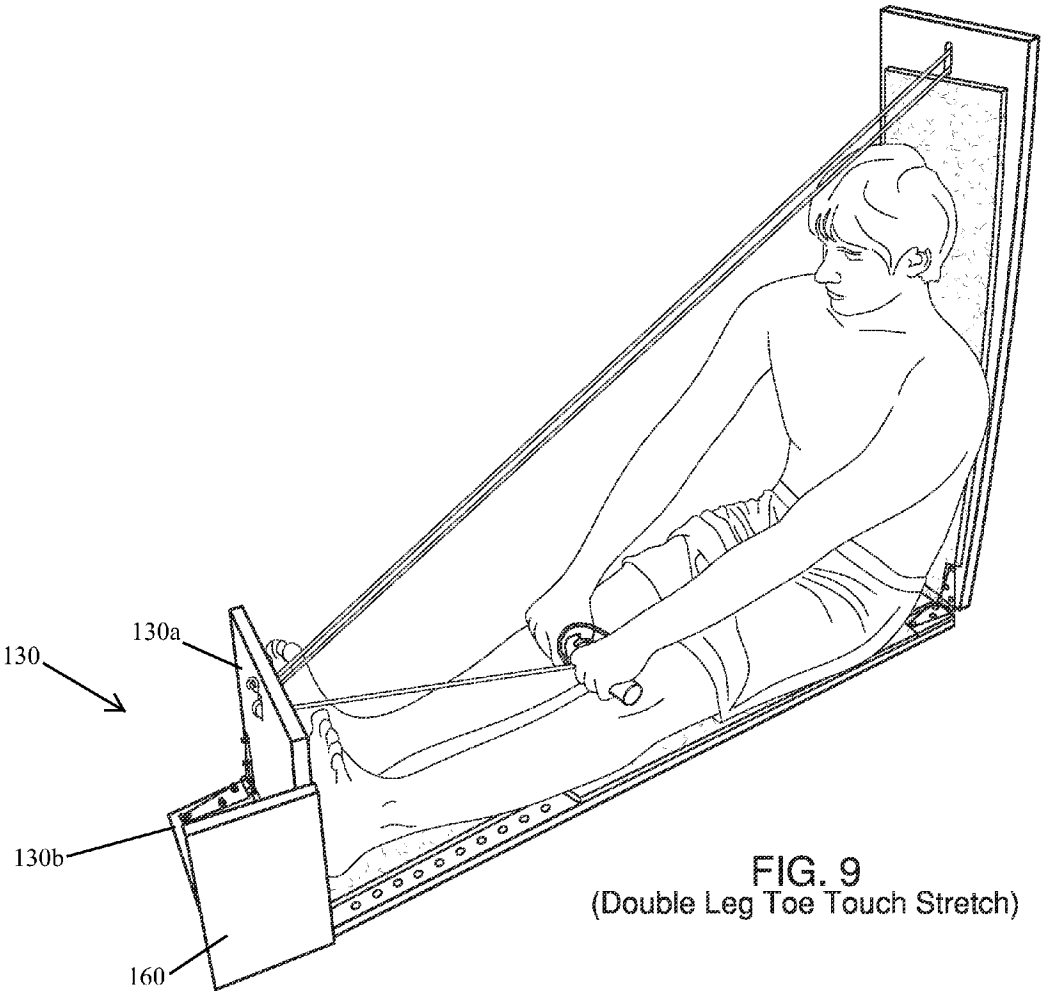
FIG. 9 is an in-use view of the stretching assistance system of the present invention (a double leg toe touch stretch is performed).

Pivotally attached to the back end 116 of the base 110 (via a first hinge 120*a*) is a pivoting platform 120. The pivoting platform 120 may function to provide back support (e.g., see FIG. 5 showing the user's back contacting the pivoting platform 120). The pivoting platform 120 may be similar in size and shape to the base 110. For example, the pivoting platform 120 is generally elongated. The pivoting platform 120 has an inside surface 125, a back surface, a top end 121, and a bottom end 122. The bottom end 122 is pivotally connected to the back end 116 of the base 110 via the first hinge 120*a*. The pivoting platform 120 can pivot between multiple positions (about the first hinge 120*a*) including but not limited to a folded position wherein the pivoting platform 120 is positioned atop the base 110 and touching the base 110 (in a flattened position, e.g., parallel to the base 110, for the lowest profile) and a pivoted position wherein the pivoting platform 120 is at an angle 105*a* with respect to the base 110. In some embodiments, the angle 105*a* is about 120 degrees. Positions in between the folded position and the pivoted position may be used for stretching purposes (e.g., see FIG. 5, wherein the pivoting platform 120 is generally perpendicular to the base 110, see FIG. 8 wherein the pivoting platform 120 pivots inward toward the base 110 for a more flexible user). In some embodiments, the pivoting platform 120 (e.g., the inside surface 125) is covered with a second padding material 118*b*, for example foam, rubber, the like, or a combination thereof. The second padding material 118*b* may help provide comfort to a user's back and/or prevent damage when the top surface of the pivoting platform 120 comes in contact with the top surface (or first padding material 118*a*) of the base 110 when the pivoting platform 120 is moved to the folded position.

In some embodiments, the angle 105*a* is about 120 degrees. In some embodiments, the angle 105*a* is between about 30 to 60 degrees. In some embodiments, the angle 105*a* is between about 45 to 90 degrees. In some embodiments, the angle 105*a* is between about 60 to 90 degrees. In some embodiments, the angle 105*a* is between about 90 to 120 degrees. In some embodiments, the angle 105*a* is between about 120 to 150 degrees.

The system 100 further comprises a footrest assembly 130 positioned at or near the front end 115 of the base 110. For example, the footrest assembly 130 comprises a footrest base 130*b* disposed atop the base 110 at or near the front end 115 of the base 110. The footrest assembly 130 further comprises a footrest platform 130*a* that is pivotally attached to the footrest base 130*b* via a footrest hinge 130*c*. For the purposes of describing orientation, the footrest platform 130*a* is closer to the back end 116 of the base 110 than is the footrest base 130*b* and the footrest hinge 130*c* faces the front end 115 of the base 110. The footrest platform 130*b* can pivot about the footrest hinge 130*c* between an extended position (wherein the footrest hinge 130*c* extends upwardly and generally perpendicularly from the base 100, e.g., when in use) and a storage position wherein the footrest platform 130*a* is pivoted toward the footrest base 130*b* such that it is atop (and touching) the footrest base 130*b*.

The footrest platform 130*a* may be a generally flat panel, however the footrest platform 130*a* is not limited to this configuration. The footrest platform 130*a* provides a platform for a user to place his/her feet (e.g., see FIG. 5). The footrest platform 130*a* has an inside surface 133, the inside surface 133 being the surface that faces the pivoting platform 120. In some embodiments, the footrest platform 130*a* (e.g., the inside surface 133) is covered with a third padding material 118*c*, for example foam, rubber, the like, or a combination thereof. The third padding material 118*c* may help provide comfort to a user's feet.

In some embodiments, the position of the footrest assembly 130 can be adjusted. For example, in some embodiments, a plurality of adjustment holes 170 are disposed in the base 110 (e.g., in the top surface at and near the front end 115), wherein the footrest base 130*b* (and effectively the footrest hinge 130*b* and footrest platform 130*a*) can be attached to the adjustment holes 170 (e.g., via hardware 172 such as two sets of bolts, screws, washers and wing nuts). In some embodiments the footrest assembly 130 adjusts along a track disposed on the base 110 (at the front end 115). With the hardware 172 removed, the track allows the footrest assembly 130 to slide forwardly (toward the front end 115 of the base 110) and backwardly (toward the back end 116 of the base) along the track until the appropriate position is achieved for the user. Then, the hardware 172 can be reinstalled to secure the footrest assembly 130 in place. The adjustability of the footrest assembly 130 allows the system 100 to accommodate users of various heights. The present invention is not limited to an adjustment hole system or a track system of adjusting the footrest assembly 130 into different positions.

A first pulley component 140*a* is disposed in the pivoting platform 120 at or near the front end. A second pulley component 140*b* is disposed in the footrest platform 130*a* at or near the top end of the footrest platform 130*a*. A rope 150 engages the first pulley component 140*a* and the second pulley component 140*b* (e.g., the rope 150 connects the two pulley components 140 together). Generally, the rope 150 has a first end 151 that is attached to the footrest platform 130*a* (e.g., near the second pulley component 140*b*). From the footrest platform 130*a*, the rope 150 extends to the first pulley component 140*a* and wraps around the first pulley component 140*a*. From the first pulley component 140*a*, the rope 150 extends to the second pulley component 140*b* and wraps around the second pulley component 140*b*. The second end 152 of the rope 150 extends outwardly from the second pulley component 140*b* (e.g., see FIG. 4 and FIG. 5), passes through the locking cleat 190 see FIG. 3), and attaches to a handle 180 (e.g., doe handle).

When the second end 152 of the rope 150 is pulled (e.g., via the handle 180), the pivoting panel 120 pivots toward the footrest assembly 130. This movement can help press slightly upon the user's back, helping the user achieve a stretch without having to strain and allows the stretch to be held as long as desired. As the user continues to pull on the handle 180, excess rope can be coiled up on the handle 180 to maintain a comfortable position for the user. When the user releases the rope 150 (for moving the rope upward), the pivoting panel 120 is no longer pulled toward the footrest assembly 130 and the pressure on the user's back is relieved, thereby ending the stretch.

Figure 1:
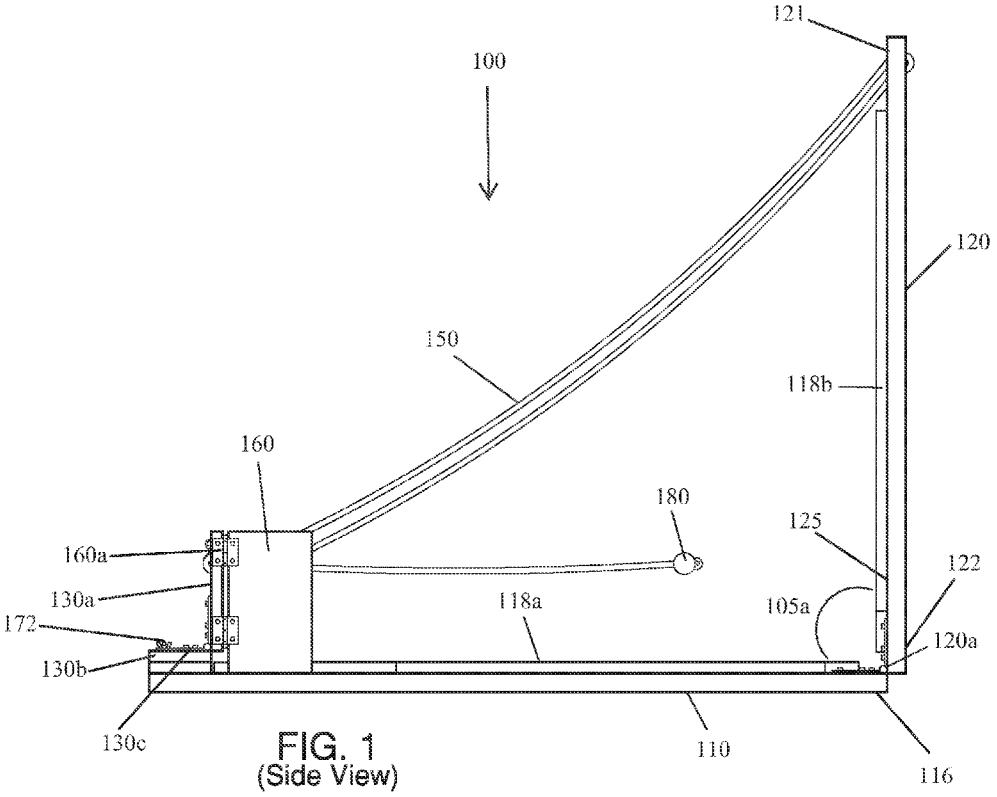
FIG. 1 is a side view of the stretching assistance system of the present invention.
Figure 2:
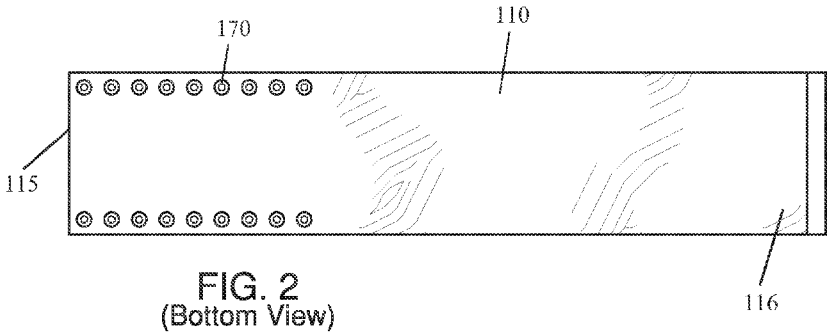
FIG. 2 is a bottom view of the stretching assistance system of the present invention.
Figure 3:
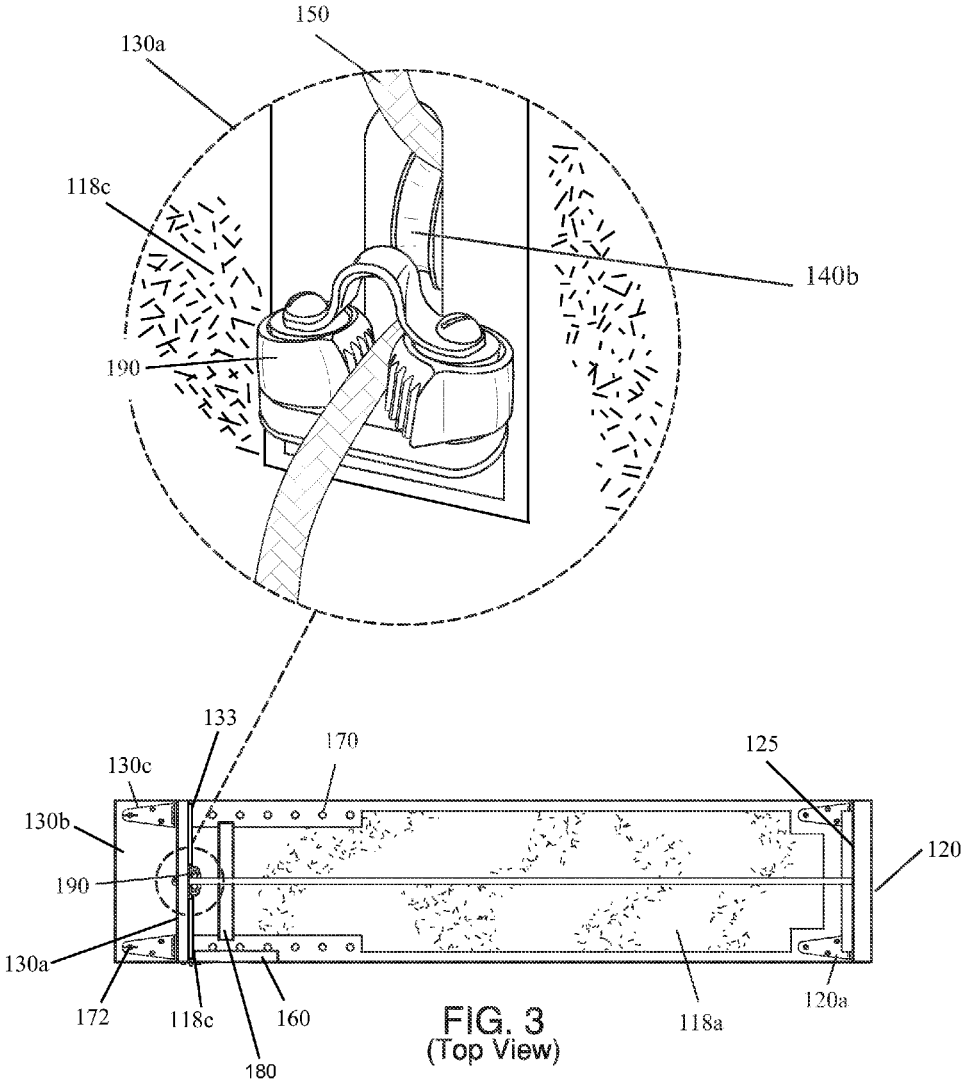
FIG. 3 is a top view of the stretching assistance system of the present invention.
Figure 4:
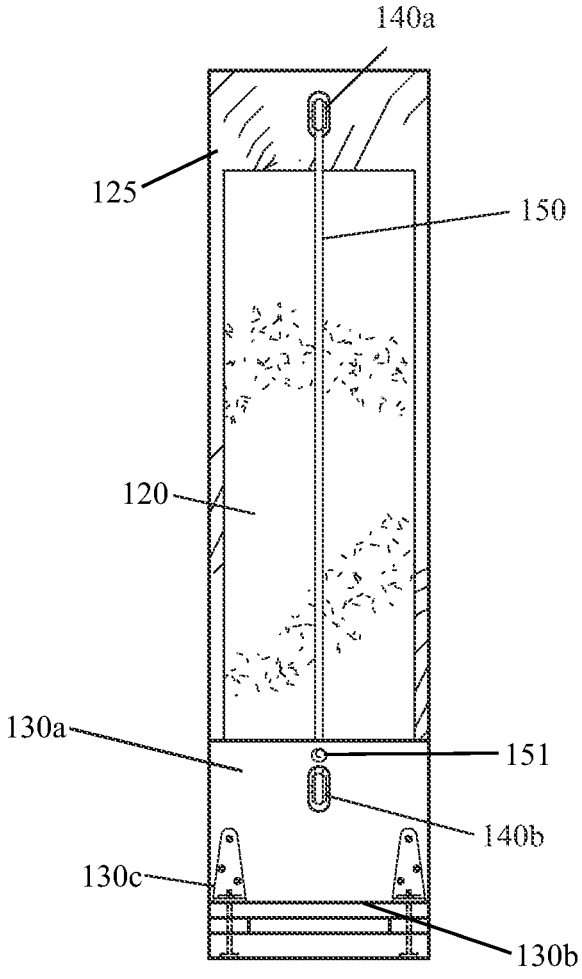
FIG. 4 is a front view of the stretching assistance system of the present invention.

A locking cleat 190 is disposed on the footrest platform 130*a*, for example below the second pulley component 140*b* (e.g., see FIG. 3). The locking cleat 190 functions to temporarily hold the rope 150 in a fixed position so that the user does not have to continue to pull on the rope 150 (and therefore can relax in the stretched position). Locking cleats are well known to one of ordinary skill in the art.

In some embodiments, a side panel 160 is pivotally attached to a first side edge of the footrest platform 130*a* (e.g., via a side panel hinge 160*a*). The side panel 160 functions to support the footrest platform 130*a* in a generally vertical position. For example, the side panel 160 may be used for stretches including but not limited to a spread eagle stretch and butterfly stretch (e.g., when the user's feet are not in contact with the footrest platform 130*a* to support it vertically). Generally, the footrest assembly 130 must be in a vertical position for the locking cleat 190 to function properly.

The system 100 of the present invention may be constructed in a variety of sizes. For example, in some embodiments, the base 110 is about 54.5 inches in length as measured from the front end 115 to the back end 116. In some embodiments, the base 110 is between about 50 to 60 inches in length as measured from the front end 115 to the back end 116. In some embodiments, the base 110 is between about 60 to 70 inches in length as measured from the front end 115 to the back end 116. In some embodiments, the base 110 is more than about 70 inches in length. In some embodiments, the pivoting platform 120 is about 41.5 inches in length as measured from the top end to the bottom end. In some embodiments, the pivoting platform 120 is between about 40 to 50 inches in length as measured from the front end to the back end. In some embodiments, the pivoting platform 120 is between about 50 to 60 inches in length as measured from the front end to the back end. In some embodiments, the pivoting platform 120 is more than about 60 inches in length. The present invention is not limited to the aforementioned dimensions.

As used herein, the term "about" refers to plus or minus 10% of the referenced number. For example, an embodiment wherein the base 110 is about 54 inches in length includes a base 110 that is between 48.6 and 59.4 inches in length.

The disclosures of the following U.S. Patents are incorporated in their entirety by reference herein: U.S. Pat. No. 4,819,936; U.S. Pat. Application No. 2004/0157712; U.S. Pat. No. 7,458,922; U.S. Pat. No. 4,844,054; U.S. Pat. No. 6,203,473; U.S. Pat. No. 6,352,495; U.S. Design Pat. No. D344,771; U.S. Pat. No. 5,762,592; U.S. Pat. No. 7,476,182; U.S. Pat. No. 5,004,228.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. A stretching assistance system 100 for helping a user stretch, said stretching assistance system 100 comprising:

(a) a generally elongated base 110 having a front end 115 and a back end 116, the base 110 functions as a seat for a user;

(b) a generally elongated pivoting platform 120 pivotally attached to the back end 116 of the base 110 via a first hinge 120*a*, the pivoting platform 120 functions to contact a user's back, the pivoting platform 120 can pivot between multiple positions including a folded position wherein the pivoting platform 120 is folded inwardly and positioned atop the base 110 and generally flush with the base 110, and an extended position wherein the pivoting platform 12 is at an angle with respect to the base 110, in the extended position a user can comfortably sit on the base 110;

(c) a footrest assembly 130 disposed atop the base 110, the footrest assembly 130 comprises a footrest base 110*b* disposed atop the base 110 at or near the front end 115 of the base 110 and a footrest platform 130*a* pivotally attached to the footrest base 130*b* via a footrest hinge 130*c*, the footrest platform 130*a* faces the back end 116 of the base 110 and can pivot about the footrest hinge 130*c* between at least an extended position wherein the footrest hinge 130*c* extends upwardly and generally perpendicularly from the footrest base 130*b* and a storage position wherein the footrest platform 130*a* is pivoted toward the footrest base 130*b* such that it is atop and generally flush with the footrest base 130*b*, the footrest assembly 130 functions to support a user's feet when the user is sitting on the base with his back to the pivoting platform 120;

(d) an adjustment means for adjusting a position of the footrest assembly 130 with respect to the front end 115 of the base 110, the adjustment means functions to allow the stretching assistance system 100 to accommodate users of various heights;

(e) a first pulley component 140*a* disposed in the pivoting platform 120 at or near a top end 121 of the pivoting platform 120, and a second pulley component 140*b* disposed in the footrest platform 130*a* at or near a top end of the footrest platform 130*a;*

(f) a rope 150 having a first end 151 and a second end 152, the first end 152 of the rope is attached to the footrest assembly 130*a*, the rope 150 extends from the footrest assembly 130*a* to the first pulley component 140*a* and wraps around the first pulley component 140*a* and further extends to the second pulley component 140*b* and wraps around the second pulley component 140*b*, the second end 152 of the rope extends outwardly from the second pulley component 140*b;*

(g) a handle 180 attached to the second end of the rope 152; and (h) a locking cleat 190 disposed on the footrest platform 130*a;* wherein when the second end 152 of the rope 150 is pulled, the pivoting panel 120 pivots toward the footrest assembly 130, wherein the locking cleat 190 functions to temporarily hold the rope 150 in a fixed position so that the user does not have to continue to pull on the rope 150 during a stretch.

2. The system 100 of claim 1, wherein the angle is about 120 degrees.

3. The stretching assistance system of claim 1 further comprising a first padding material 118*a* disposed on a top surface of the base 110.

4. The stretching assistance system of claim 3, wherein the first padding material 118*a* is foam, rubber, or a combination thereof.

5. The stretching assistance system of claim 1 further comprising a second padding material 118*b* disposed on an inside surface 125 of the pivoting platform 120.

6. The stretching assistance system of claim 5, wherein the second padding material 118*b* is foam, rubber, or a combination thereof.

7. The stretching assistance system of claim 1 further comprising a third padding material 118*c* disposed on an inside surface 133 of the footrest platform 130*a*, the inside surface of the footrest platform 130 faces towards a user's feet.

8. The stretching assistance system of claim 7, wherein the third padding material 118*c* is foam, rubber, or a combination thereof.

9. The stretching assistance system of claim 1, wherein the adjustment means comprises a plurality of adjustment holes 170 disposed in the base 10 at and near the front end 115 of the base 110, and hardware 172 temporarily disposed in the footrest assembly 130 and engaged in the adjustment holes 170.

10. The stretching assistance system of claim 1, wherein the handle 180 is a dowel handle for coiling up excess rope.

11. The stretching assistance system of claim 1 further comprising a side panel 160 pivotally attached to a first side edge of the footrest platform 130*a* via a side panel hinge 160*a*.

* * * * *